US010453435B2

(12) United States Patent
Nariyama et al.

(10) Patent No.: US 10,453,435 B2
(45) Date of Patent: Oct. 22, 2019

(54) MUSICAL SOUND EVALUATION DEVICE, EVALUATION CRITERIA GENERATING DEVICE, METHOD FOR EVALUATING THE MUSICAL SOUND AND METHOD FOR GENERATING THE EVALUATION CRITERIA

(71) Applicant: Yamaha Corporation, Hamamatsu-shi, Shizuoka (JP)

(72) Inventors: Ryuichi Nariyama, Hamamatsu (JP); Shuichi Matsumoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/958,343

(22) Filed: Apr. 20, 2018

(65) Prior Publication Data

US 2018/0240448 A1 Aug. 23, 2018

Related U.S. Application Data

(63) Continuation of application No. PCT/JP2016/079770, filed on Oct. 6, 2016.

(30) Foreign Application Priority Data

Oct. 22, 2015 (JP) ..... 2015-208173

(51) Int. Cl.
*G10H 1/36* (2006.01)
*G10H 1/44* (2006.01)
(Continued)

(52) U.S. Cl.
CPC ..... *G10H 1/366* (2013.01); *G10H 1/44* (2013.01); *G10L 25/51* (2013.01);
(Continued)

(58) Field of Classification Search
CPC .... G10H 1/366; G10H 1/44; G10H 2210/066; G10H 2210/081; G10H 2210/091;
(Continued)

(56) References Cited

U.S. PATENT DOCUMENTS 5,889,224 A * 3/1999 Tanaka ..... G10H 1/361 434/307 A
7,348,482 B2 * 3/2008 Ishii ..... G10H 1/0075 84/604
(Continued)

FOREIGN PATENT DOCUMENTS

JP 10-49183 A 2/1998
JP 2009-92871 A 4/2009
(Continued)

OTHER PUBLICATIONS

English translation of document C2 (Japanese-language Written Opinion (PCT/ISA/327 previously filed Apr. 20, 2018)) issued in PCT Application No. PCT/JP2016/079770 dated Dec. 13, 2016 (five (5) pages).
(Continued)

*Primary Examiner* — David S Warren
*Assistant Examiner* — Christina M Schreiber
(74) *Attorney, Agent, or Firm* — Crowell & Moring LLP

(57) ABSTRACT

A musical sound evaluation device includes a musical sound acquisition unit which acquires an inputted musical sound, a feature quantity calculation unit which calculates a feature quantity from the musical sound, a feature quantity distribution data acquisition unit which acquires feature quantity distribution data representing a distribution of respective feature quantities for a plurality of musical sounds previously acquired, an evaluation value calculation unit which calculates an evaluation value for the inputted musical sound based on the feature quantity calculated by the feature
(Continued)

quantity calculation unit and the feature quantity distribution data acquired by the feature quantity distribution data acquisition unit, and an evaluation unit which evaluates the musical sound based on the evaluation value.

12 Claims, 10 Drawing Sheets

(51) Int. Cl.
*G10L 25/51* (2013.01)
*G10L 25/09* (2013.01)
*G10L 25/90* (2013.01)

(52) U.S. Cl.
CPC . *G10H 2210/066* (2013.01); *G10H 2210/081* (2013.01); *G10H 2210/091* (2013.01); *G10H 2210/331* (2013.01); *G10L 25/09* (2013.01); *G10L 25/90* (2013.01)

(58) Field of Classification Search
CPC ... G10H 2210/331; G10L 25/51; G10L 25/09; G10L 25/90
USPC ..... 84/610
See application file for complete search history.

(56) References Cited

U.S. PATENT DOCUMENTS

| | | | | |
|---|---|---|---|---|
| 7,829,777 | B2 * | 11/2010 | Kyuma | G10H 1/368 84/477 R |
| 8,178,770 | B2 * | 5/2012 | Kobayashi | G10H 1/383 84/613 |
| 8,420,921 | B2 * | 4/2013 | Kobayashi | G10H 1/40 84/613 |
| 9,087,501 | B2 * | 7/2015 | Maezawa | G10H 7/002 |
| 9,171,532 | B2 * | 10/2015 | Maezawa | G10H 1/40 |
| 9,536,508 | B2 * | 1/2017 | Okazaki | G10H 1/38 |
| 9,542,918 | B2 * | 1/2017 | Matusiak | G10H 1/0025 |
| 9,557,956 | B2 * | 1/2017 | Kobayashi | G06T 13/205 |
| 9,792,889 | B1 * | 10/2017 | Obara | G10H 1/0025 |
| 9,830,896 | B2 * | 11/2017 | Wang | G10H 1/40 |
| 2006/0036640 | A1 * | 2/2006 | Tateno | G06F 16/907 |
| 2007/0250319 | A1 * | 10/2007 | Tateishi | G10L 15/26 704/251 |
| 2010/0186576 | A1 * | 7/2010 | Kobayashi | G10H 1/40 84/612 |
| 2014/0260912 | A1 * | 9/2014 | Maezawa | G10H 1/40 84/612 |
| 2018/0174561 | A1 * | 6/2018 | Nariyama | G10H 1/361 |
| 2018/0240448 | A1 * | 8/2018 | Nariyama | G10L 25/51 |
| 2018/0357920 | A1 * | 12/2018 | Terashima | G10G 7/02 |

FOREIGN PATENT DOCUMENTS

| | | | |
|---|---|---|---|
| JP | 2009092871 | A | 4/2009 |
| JP | 2012-194389 | A | 10/2012 |
| JP | 2014-66740 | A | 4/2014 |
| JP | 2014066740 | A | 4/2014 |
| JP | 2014-191192 | A | 10/2014 |
| JP | 2014191192 | A | 10/2014 |
| WO | WO 2015/111671 | A1 | 7/2015 |

OTHER PUBLICATIONS

International Search Report (PCT/ISA/220 & PCT/ISA/210) issued in PCT Application No. PCT/JP2016/079770 dated Dec. 13, 2016 with English translation (seven pages).
Japanese-language Written Opinion (PCT/ISA/237) issued in PCT Application No. PCT/JP2016/079770 dated Dec. 13, 2016 (four pages).
Japanese Office Action dated Sep. 3, 2019 with partial machine translation for corresponding Japanese Patent Application No. 2015-208173 (five (5) pages).

* cited by examiner

MUSICAL SOUND EVALUATION DEVICE, EVALUATION CRITERIA GENERATING DEVICE, METHOD FOR EVALUATING THE MUSICAL SOUND AND METHOD FOR GENERATING THE EVALUATION CRITERIA

CROSS REFERENCE TO RELATED APPLICATIONS

This application is based upon and claims the benefit of priority from the prior Japanese Patent Application No. 2015-208173 filed on Oct. 22, 2015, and PCT Application No. PCT/JP2016/079770 filed on Oct. 6, 2016, the entire contents of which are incorporated herein by reference.

FIELD

The present invention relates to a technique for evaluating musical sounds (a performance sound of a musical instrument, a singing sound of a person, and other musical sounds).

BACKGROUND

A karaoke device may have a function of analyzing and evaluating a singing voice in many cases. Various methods are used for singing evaluation. As one of the methods, a technique for comparing level data acquired from a voice of a singer with level data composing Musical Instrument Digital Interface (MIDI) messages of a reference singing sound included in original musical piece data and evaluating a singing in response to a difference therebetween is disclosed, for example, in Japanese Patent Application Laid-Open No. H10-49183.

SUMMARY

According to an aspect of the present invention, a musical sound evaluation device includes a musical sound acquisition unit which acquires an inputted musical sound, a feature quantity calculation unit which calculates a feature quantity from the musical sound, a feature quantity distribution data acquisition unit which acquires feature quantity distribution data representing a distribution of respective feature quantities for a plurality of musical sounds previously acquired, an evaluation value calculation unit which calculates an evaluation value for the inputted musical sound based on the feature quantity calculated by the feature quantity calculation unit and the feature quantity distribution data acquired by the feature quantity distribution data acquisition unit, and an evaluation unit which evaluates the musical sound based on the evaluation value.

The evaluation value calculation unit may weight the evaluation value depending on a degree of scatter of the distribution of the feature quantities. As the degree of scatter, a dispersion or a standard deviation can be used.

The above-described musical sound evaluation device may include a key shift determination unit which determines an amount of key shift in the inputted musical sound, and a key shift correction unit which corrects the feature quantity calculated by the feature quantity calculation unit using the amount of key shift determined by the key shift determination unit.

The above-described musical sound evaluation device may include a section information acquisition unit which acquires section information including information representing a feature for each section in the inputted musical sound, in which the evaluation unit may weight the evaluation value based on the section information.

According to another aspect of the present invention, an evaluation criteria generation device includes a musical sound information acquisition unit which acquires information representing a musical sound, a feature quantity data acquisition unit which acquires feature quantity data respectively representing temporal changes of feature quantities for n musical sounds, and a feature quantity distribution data generation unit which performs statistical processing using the feature quantity data for the musical sounds acquired from the information representing the musical sound and the respective feature quantity data for the n musical sounds, to generate feature quantity distribution data representing a distribution of respective feature quantities for (n+1) musical sounds.

The above-described evaluation criteria generation device may include an output unit which outputs an identifier for identifying a musical piece related to the musical sound and the feature quantity distribution data to the outside in association with each other. At this time, the identifier for identifying the musical piece, together with the information representing the musical sound acquired by the musical sound information acquisition unit, may be acquired.

According to still another aspect of the present invention, a musical sound evaluation method includes acquiring an inputted musical sound, calculating a feature quantity from the musical sound, acquiring feature quantity distribution data representing a distribution of respective feature quantities for a plurality of musical sounds previously acquired, calculating an evaluation value for the inputted musical sound based on the calculated feature quantity and the acquired feature quantity distribution data, and evaluating the musical sound based on the evaluation value.

According to a further aspect of the present invention, an evaluation criteria generation method includes acquiring information representing a musical sound, acquiring feature quantity data respectively representing temporal changes of feature quantities for n musical sounds, performing statistical processing using the feature quantity data for the musical sounds acquired from the information representing the musical sound and the respective feature quantity data for the n musical sounds, to generate feature quantity distribution data representing a distribution of respective feature quantities for (n+1) musical sounds.

DESCRIPTION OF EMBODIMENTS

Figure 1:
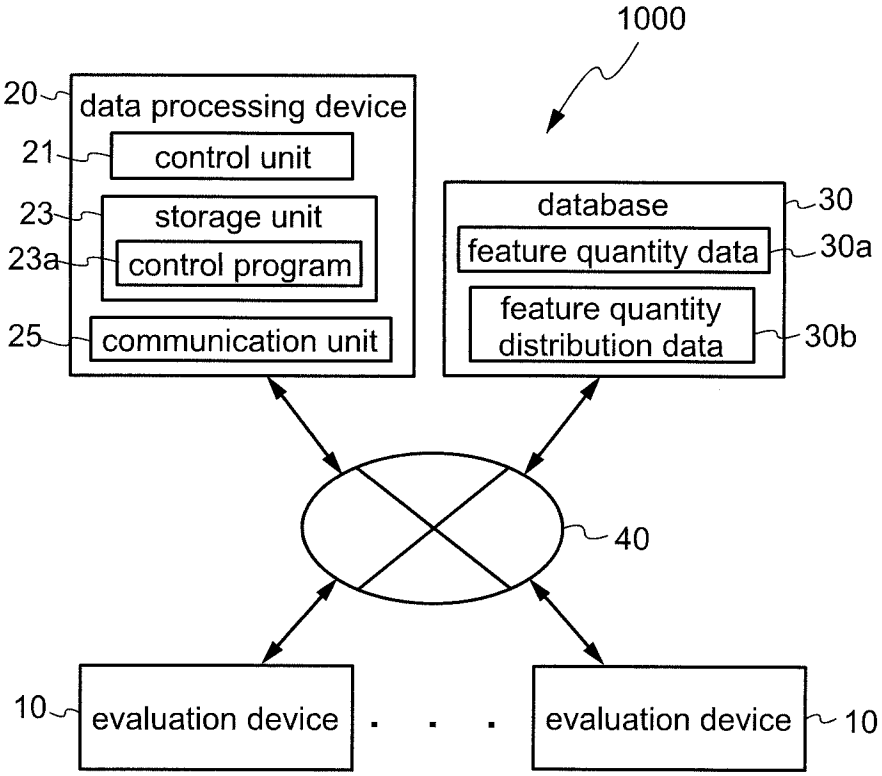
FIG. 1 is a block diagram illustrating a configuration of a data processing system according to a first embodiment.

In a technique described in Japanese Patent Application Laid-Open No. H10-49183, an MIDI message of a reference singing sound needs to be previously included in musical piece data as a reference of singing evaluation. On the other hand, if musical piece data not including such a reference singing sound is used, singing evaluation cannot be performed. In that respect, there was room for improvement.

One of problems of the present invention is to provide a technique for enabling a musical sound to be evaluated using musical piece data not including a reference.

An evaluation device in one embodiment of the present invention will be specifically described below with reference to the drawings. Embodiments, described below, are each an example of the embodiment of the present invention. The present invention is not limited to the embodiments. In the drawings referred to in the present embodiment, identical portions or portions having similar functions are respectively assigned identical or similar symbols (numerals followed by A, B, or the like), and repetitive description thereof may be omitted.

First Embodiment

[Configuration of Data Processing System]

FIG. 1 is a block diagram illustrating a configuration of a data processing system according to a first embodiment of the present invention. A data processing system 1000 includes at least one evaluation device 10, a data processing device 20, and a database 30. The components are connected to one another via a network 40 such as the Internet. In this example, the plurality of evaluation devices 10 are connected to the network 40. The evaluation device 10 is a karaoke device, for example. In this example, the evaluation device 10 is a karaoke device capable of performing singing evaluation. The evaluation device 10 may be a terminal device such as a smartphone.

In the present embodiment, singing voices are respectively inputted in the evaluation devices 10, and statistical processing for finding a distribution of respective feature quantities of the singing voices is performed in the data processing device 20. Data representing a feature quantity (feature quantity data 30*a*) found in time series from singing voice data and data representing a distribution of feature quantities (feature quantity distribution data 30*b*) for each predetermined timing obtained by performing statistical processing for a plurality of feature quantity data 30*a* are registered in the database 30.

In the present embodiment, a pitch (a base frequency) of a singing voice is used as a feature quantity of the singing voice. In the present embodiment, data representing a temporal change of a pitch (hereinafter referred to as "pitch waveform data") calculated from singing voice data is used as feature quantity data. Further, data representing a frequency distribution of pitches for each predetermined timing found by statistical processing for a plurality of pitch waveform data is used as feature quantity distribution data. At this time, the feature quantity data may be calculated in the evaluation device 10, or may be calculated in the data processing device 20.

As described above, in the database 30, the feature quantity data 30*a* generated from the singing voice in each of the evaluation devices 10 or the data processing device 20 is associated with each musical sound and is registered. The feature quantity distribution data 30*b* generated from the plurality of feature quantity distribution data 30*a* is associated with each musical piece (e.g., each identifier for identifying a musical piece associated with a singing voice) and is registered.

While a configuration in which the data processing device 20 and the database 30 are connected to each other via the network 40 is illustrated in FIG. 1, the present invention is not limited to this. A configuration in which the database 30 is physically connected to the data processing device 20 may be used. Not only the feature quantity data but also the singing voice data serving as its basis may be registered in the database 30.

[Configuration of Data Processing Device]

As illustrated in FIG. 1, the data processing device 20 includes a control unit 21, a storage unit 23, and a communication unit 25. The control unit 21 includes a calculation processing circuit such as a central processing unit (CPU). The control unit 21 executes a control program 23*a* stored in the storage unit 23 using the CPU, to implement various types of functions in the data processing device 20. The functions to be implemented include a function of performing statistical processing for respective feature quantities of singing voices to generate feature quantity distribution data serving as an evaluation criterion of the singing voices (an evaluation criteria generating function). The evaluation criteria generating function will be described below.

The storage unit 23 is a storage device such as a nonvolatile memory or a hard disk. The storage unit 23 stores the control program 23*a* for implementing the evaluation criteria generating function. The control program 23*a* may be executable by a computer, and may be provided while being stored in a computer readable recording medium such as a magnetic recording medium, an optical recording medium, a magnetooptical recording medium, or a semiconductor memory. In this case, the data processing device 20 may include a device which reads a recording medium. The control program 23*a* may be downloaded from an external server or the like via the network 40. The communication unit 25 is connected to the network 40 based on control by the control unit 21, to transmit or receive information to or from an external device connected to the network 40.

[Configuration of Evaluation Device]

Figure 2:
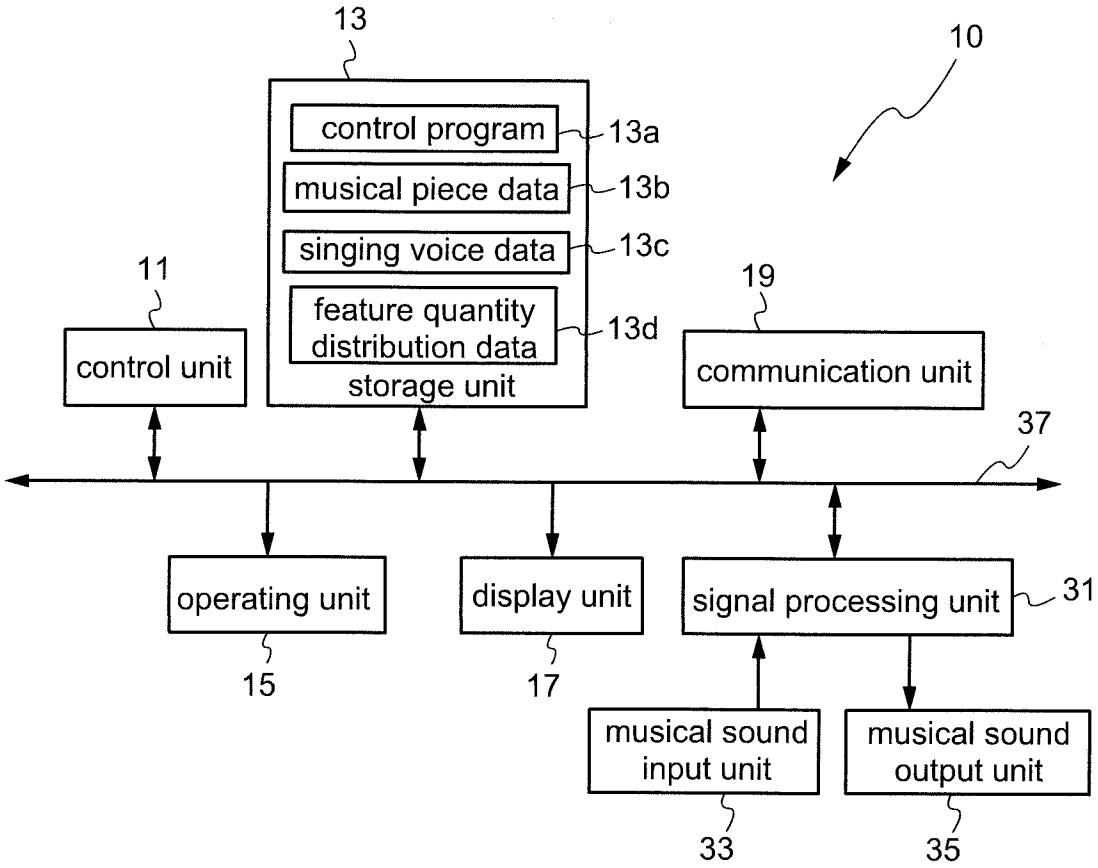
FIG. 2 is a block diagram illustrating a configuration of a musical sound evaluation device in the first embodiment.

The evaluation device 10 in the first embodiment of the present invention will be described. FIG. 2 is a block diagram illustrating a configuration of the evaluation device 10 in the first embodiment of the present invention. The evaluation device 10 is a karaoke device having a singing scoring function, for example. The evaluation device 10 includes a control unit 11, a storage unit 13, an operation unit 15, a display unit 17, a communication unit 19, and a signal processing unit 31. A musical sound input unit (e.g., a microphone) 33 and a musical sound output unit (e.g., a speaker) 35 are connected to the signal processing unit 31. The components are connected to one another via a bus 37.

The control unit 11 includes a calculation processing circuit such as a CPU. The control unit 11 executes a control program 13*a* stored in the storage unit 13 using the CPU, to implement various types of functions in the evaluation device 10. The functions to be implemented include a singing voice evaluating function. In the present embodiment, the singing scoring function in karaoke is illustrated as a specific example of the singing voice evaluating function.

The storage unit 13 is a storage device such as a non-volatile memory or a hard disk. The storage unit 13 stores a control program 13*a* for implementing the singing voice evaluating function. The control program 13*a* may be provided while being stored in a computer readable recording medium such as a magnetic recording medium, an optical recording medium, a magnetooptical recording medium, or a semiconductor memory. In this case, the evaluation device 10 may include a device which reads the recording medium. The control program 13*a* may be downloaded via the network 40 such as the Internet.

The storage unit 13 stores musical piece data 13*b*, singing voice data 13*c*, and feature quantity distribution data 13*d* as data relating to a singing. The musical piece data 13*b* includes data associated with a singing piece in karaoke, e.g., accompaniment data and lyric data. The accompaniment data is data representing accompaniment of the singing piece. The accompaniment data may be data represented in an MIDI format. The lyric data is data for displaying a lyric of the singing piece and data representing a timing at which a color of a telop of the displayed lyric. The musical piece data 13*b* may include guide melody data representing a melody of the singing piece. However, the guide melody data is not an essential component. If the musical piece data 13*b* does not include guide melody data, singing evaluation can be performed.

The singing voice data 13*c* is data representing a singing voice inputted from the musical piece input unit 33 by a singer. That is, the storage unit 13 functions as a buffer of the singing voice data 13*c*. In the present embodiment, the singing voice data 13*c* is stored in the storage unit 13 until the singing voice is evaluated by a singing voice evaluating function. After the evaluation of the singing voice has ended, the singing voice data 13*c* may be transmitted to the data processing device 20 or the database 30.

The feature quantity distribution data 13*d* is data representing a result of statistical processing for respective pitch waveform data of a plurality of singing voices. For example, as the feature quantity distribution data 13*d*, data representing a frequency distribution of pitches at each timing obtained as a result of performing statistical processing for a plurality of singing voices sung in the past using their respective pitch waveform data can be used. The feature quantity distribution data 13*d* can include various types of statistics which can be calculated from the frequency distribution. Examples of the statistics can include a degree of scatter (standard deviation, dispersion) and a representative value (mode, median, mean). The feature quantity distribution data 13*d* is an evaluation criterion in the evaluation of the singing voice.

The operation unit 15 is a device such as an operation button, a keyboard, and a mouse provided in an operation panel and a remote control, and outputs a signal corresponding to an inputted operation to the control unit 11. The display unit 17 is a display device such as a liquid crystal display or an organic electro-luminescence (EL) display, and a screen based on the control by the control unit 11 is displayed thereon. The operation unit 15 and the display unit 17 may integrally constitute a touch panel. The communication unit 19 is connected to a communication line such as the Internet or a Local Area Network (LAN) based on the control by the control unit 11, to transmit or receive information to or from an external device such as a server. The function of the storage unit 13 may be implemented by an external device with which the communication unit 19 can communicate.

The signal processing unit 31 includes a sound source which generates an audio signal from a signal in an MIDI format, an analog-to-digital (A/D) converter, a digital-to-analog (D/A) converter, and the like. A singing voice is converted into an electric signal in a musical sound input unit 33 such as a microphone, and is then inputted to the signal processing unit 31. Further, the singing voice is subjected to A/D conversion in the signal processing unit 31, and is then outputted to the control unit 11. As described above, the singing voice is stored in the storage unit 13 as the singing voice data 13*c*. Accompaniment data is read out by the control unit 11, and is subjected to D/A conversion in the signal processing unit 31. Then, the accompaniment data is outputted as an accompaniment sound of a singing piece from a musical sound output unit 35 such as a speaker. At this time, a guide melody may be outputted from the musical sound output unit 35.

[Musical Sound Evaluating Function]

A musical sound evaluating function implemented by the control unit 11 in the evaluation device 10 executing the control program 13*a* stored in the storage unit 13 will be described. Some or all of constitutional elements for implementing the musical sound evaluating function described below may be implemented by hardware. The musical sound evaluating function described below may be implemented as a musical sound evaluation method or a musical sound evaluation program. That is, processes respectively executed by the constitutional elements constituting the musical sound evaluating function (or instructions to execute the processes) are respectively included in constitutional elements constituting the musical sound evaluation method (or musical sound evaluation program).

Figure 3:
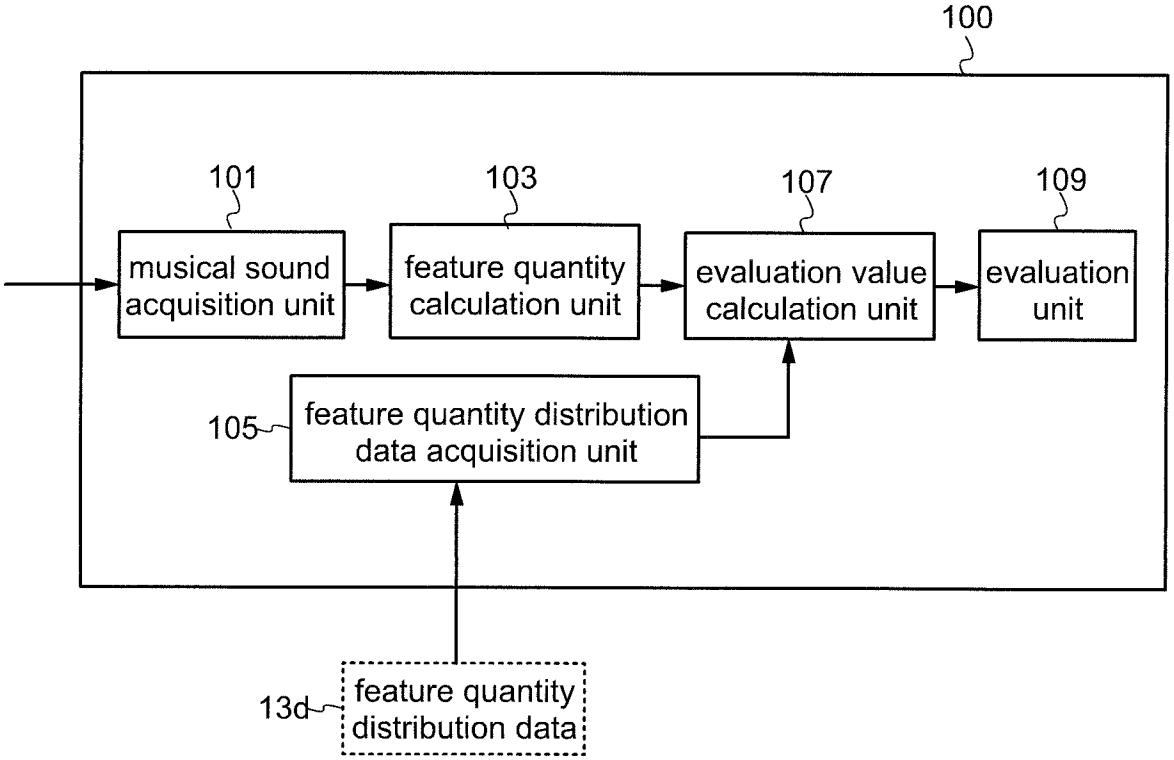
FIG. 3 is a block diagram illustrating a configuration of a musical sound evaluating function in the first embodiment.

FIG. 3 is a block diagram illustrating a configuration of a musical sound evaluating function 100 in the first embodiment of the present invention. The musical sound evaluating function 100 includes a musical sound acquisition unit 101, a feature quantity calculation unit 103, a feature quantity distribution data acquisition unit 105, an evaluation value calculation unit 107, and an evaluation unit 109.

The musical sound acquisition unit 101 acquires singing voice data representing an inputted singing voice. In this example, an input sound to the musical sound input unit 33 in a period during which an accompaniment sound is being outputted is recognized as a singing voice to be evaluated. The musical sound acquisition unit 101 may directly acquire the singing voice data 13*c* from the signal processing unit 31, although it acquires the singing voice data 13*c* stored in the storage unit 13 in the present embodiment. The musical sound acquisition unit 101 does not necessarily acquire singing voice data from the musical sound input unit 33. The musical sound acquisition unit 101 may acquire the singing voice data representing an input sound to the external device via the network 40 by the communication unit 19.

The feature quantity calculation unit 103 performs Fourier analysis, for example, for the singing voice data acquired by the musical sound acquisition unit 101, to calculate a pitch in time series as a feature quantity of a singing voice. The pitch may be calculated continuously in terms of time or may be calculated at predetermined time intervals. While an example in which Fourier analysis is used is illustrated in the present embodiment, other known methods such as a method using zero-crossing of a waveform of a singing voice may be used.

After the feature quantity calculated in time series by the feature quantity calculation unit 103 is stored once in the storage unit 13, the feature quantity, together with an identifier for identifying a musical piece, is then transmitted to the database 30 via the network 40, and is registered as the feature quantity data 30*a*. The feature quantity may be transmitted to the database 30 via the data processing device 20. At this time, the feature quantity calculation unit 103 may acquire an identifier for identifying a musical piece from the musical piece data 13*b* stored in the storage unit 13.

The feature quantity distribution data acquisition unit 105 acquires the feature quantity distribution data 13*d* stored in the storage unit 13. In the present embodiment, an example in which the feature quantity distribution data 13*d* downloaded from the database 30 via the network 40 is received in the communication unit 19 and is stored once in the storage unit 13 is illustrated. However, the present invention is not limited to this. The downloaded feature quantity distribution data 13*d* can also be acquired as it is.

The feature quantity distribution data 13*d*, which has been associated with the inputted musical sound, is acquired. That is, the feature quantity distribution data acquisition unit 105 acquires the feature quantity distribution data 13*d* associated with a musical piece associated with a singing voice acquired by the musical sound acquisition unit 101. This association can be performed using an identifier for identifying a musical piece, for example. In this case, the identifier for identifying the musical piece may be acquired in the musical sound acquisition unit 101.

The evaluation value calculation unit 107 calculates an evaluation value serving as a basis for singing evaluation (scoring) based on the pitch of the singing voice to be evaluated outputted from the feature quantity calculation unit 103 and the feature quantity distribution data 13*d* acquired by the feature quantity distribution data acquisition unit 105. For example, in the evaluation value calculation unit 107, it is found, based on a relationship between a pitch of a singing voice at a timing to be evaluated (hereinafter referred to as an "evaluation point") and a distribution of respective pitches of a plurality of singing voices in the past at the same timing, to which extent the pitch to be evaluated deviates from the distribution. The singing voice can be evaluated for each evaluation point by performing calculation such that the larger the extent of the deviation is, the lower the evaluation value to be calculated is.

The evaluation unit 109 evaluates the singing voice depending on the evaluation value outputted from the evaluation value calculation unit 107. Various methods can be adopted as an evaluation method. For example, the evaluation value outputted from the evaluation value calculation unit 107 may be used as it is, or the singing voice may be evaluated by weighting each of the evaluation values depending on a degree of importance or a degree of difficulty for each evaluation point.

As described above, the musical sound evaluating function 100 in the present embodiment enables singing evaluation in each of the evaluation devices 10 to be performed utilizing a plurality of singing voices stored from the past to the present as so-called big data and using information representing a distribution of respective feature quantities of the singing voices. The musical sound evaluating function 100 may be implemented by a single computer or may be implemented by a cooperation of a plurality of computers. For example, some or all of the musical sound acquisition unit 101, the feature quantity calculation unit 103, the feature quantity distribution data acquisition unit 105, the evaluation value calculation unit 107, and the evaluation unit 109 may be respectively implemented by different computers. The musical sound evaluating function 100 may be implemented by the computers performing communication via the network.

[Evaluation Criteria Generating Function]

The evaluation criteria generating function implemented by the control unit 21 in the data processing device 20 executing the control program 23*a* stored in the storage unit 23 will be described. Some or all of constitutional elements for implementing the evaluation criteria generating function described below may be implemented by hardware. The evaluation criteria generating function described below may be implemented as an evaluation criteria generation method or an evaluation criteria generation program. That is, processes respectively executed by the constitutional elements constituting the evaluation criteria generating function (or instructions to execute the processes) are respectively included in constitutional elements constituting the evaluation criteria generation method (or the evaluation criteria generation program).

Figure 4:
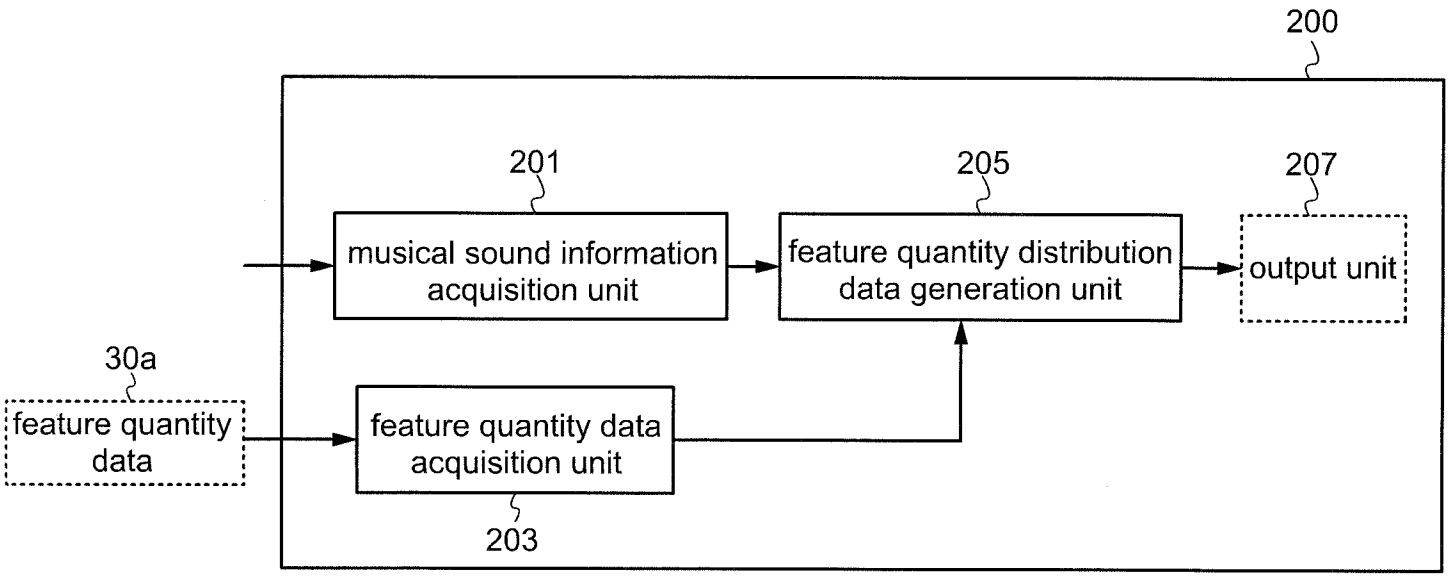
FIG. 4 is a block diagram illustrating a configuration of an evaluation criteria generating function in the first embodiment.

FIG. 4 is a block diagram illustrating a configuration of an evaluation criteria generating function 200 in the first embodiment of the present invention. The evaluation criteria generating function 200 includes a musical sound information acquisition unit 201, a feature quantity data acquisition unit 203, a feature quantity distribution data generation unit 205, and an output unit 207. The output unit 207 may be provided, as needed, and is indicated by a dotted line because it is not an essential component.

The musical sound information acquisition unit 201 acquires information representing a musical sound. In the present embodiment, as the information representing the musical sound, the singing voice data 13*c* acquired by each of the evaluation devices 10 illustrated in FIG. 1 is acquired via the network 40. That is, a plurality of singing voice data 13*c* are collected in the musical sound information acquisition unit 201, respectively, from the plurality of evaluation devices 10 connected to the musical sound information acquisition unit 201 via the network 40. As the information representing the musical sound, not only musical sound data itself such as the singing voice data 13*c* but also a feature quantity such as a pitch calculated from the musical sound data may be acquired.

The feature quantity calculation unit 203 acquires the feature quantity data 30*a* from the database 30. As described above, the feature quantity data 30*a* is data representing a feature quantity found in time series from singing voice data. In the present embodiment, the database 30 stores for each musical piece respective pitch waveform data for a plurality of singing voices respectively sung by the evaluation devices 10 in the past. The feature quantity data acquisition unit 203 can acquire, by acquiring the pitch waveform data, the pitch waveform data for the plurality of singing voices sung in the past.

The feature quantity distribution data 205 generates feature quantity distribution data based on the singing voice data 13*c* inputted from the musical sound information acquisition unit 201 and the feature quantity data 30*a* inputted from the feature quantity data acquisition unit 203. More specifically, statistical processing is performed by combining pitch waveform data obtained by analyzing and calculating the singing voice data 13*c* inputted from the musical sound information acquisition unit 201 and the pitch waveform data (pitch waveform data stored in the past) acquired from the feature quantity data acquisition unit 203, to generate data representing a pitch frequency distribution at each timing.

The pitch frequency distribution is obtained by observing a relationship between a pitch and its frequency or relative frequency. The pitch frequency distribution can be obtained by finding the frequency for each grid to which the pitch belongs, for example. The width of the grid can be optionally determined for each cent unit, and can be set every several cents or every several tens of cents, for example. At this time, the grid width is preferably determined depending on the number of populations. More specifically, the larger the number of populations is, the narrower the grid width may be (the higher the particle size of the frequency distribution may be), and the smaller the number of population is, the wider the grid width may be (the lower the particle size of the frequency distribution may be).

The feature quantity distribution data generation unit 205 can include not only the pitch frequency distribution but also statistics such as a degree of scatter (e.g., standard deviation or dispersion) and a representative value (mode, median, mean) calculated from the pitch frequency distribution.

The pitch waveform data acquired from the feature quantity data acquisition unit 203 includes respective pitches for each predetermined timing for the plurality of singing voices sung in the past. That is, if the predetermined timing is paid attention to, a plurality of pitches exist to correspond to various singings in the past. In the present embodiment, the frequency distribution at the predetermined timing can be sequentially updated by adding a pitch of a singing voice, which has been acquired via the musical sound information acquisition unit 201, to the plurality of pitches in the past and sequentially updating the populations in the statistical processing.

The output unit 207 outputs the feature quantity distribution data generated by the feature quantity distribution data generation unit 205 to the outside. For example, the output unit 207 can output the generated feature quantity distribution data to the database 30 via the network 40 illustrated in FIG. 1. The present invention is not, of course, limited to this. The feature quantity distribution data can also be outputted to any other devices connected to the network 40.

The musical sound information acquisition unit 201 may acquire, in addition to the pitch waveform data outputted from each of the evaluation devices 10, an identifier for identifying a corresponding musical piece. When the identifier for identifying the musical piece is used, the feature quantity distribution data acquisition unit 203 can acquire feature quantity data for the same musical piece as the singing voice data acquired by the musical sound information acquisition unit 201.

As described above, the evaluation criteria generating function 200 in the present embodiment can collect the singing voices sung in the past from the plurality of evaluation devices 10 connected onto the top of the network 40 and generate information representing a distribution of feature quantities of a singing voice serving as a criterion for singing evaluation based on the singing voices. Thus, evaluation can also be performed in a singing or a performance using musical piece data not including a reference. The evaluation criteria generating function 200 may be implemented by a single computer or may be implemented by a cooperation of a plurality of computers. For example, some or all of the musical sound information acquisition unit 201, the feature quantity data acquisition unit 203, and the feature quantity distribution data generation unit 205 may be respectively implemented by different computers. The evaluation criteria generating function 200 may be implemented by the computers performing communication via the network.

[One Example of Evaluation]

Figure 5:
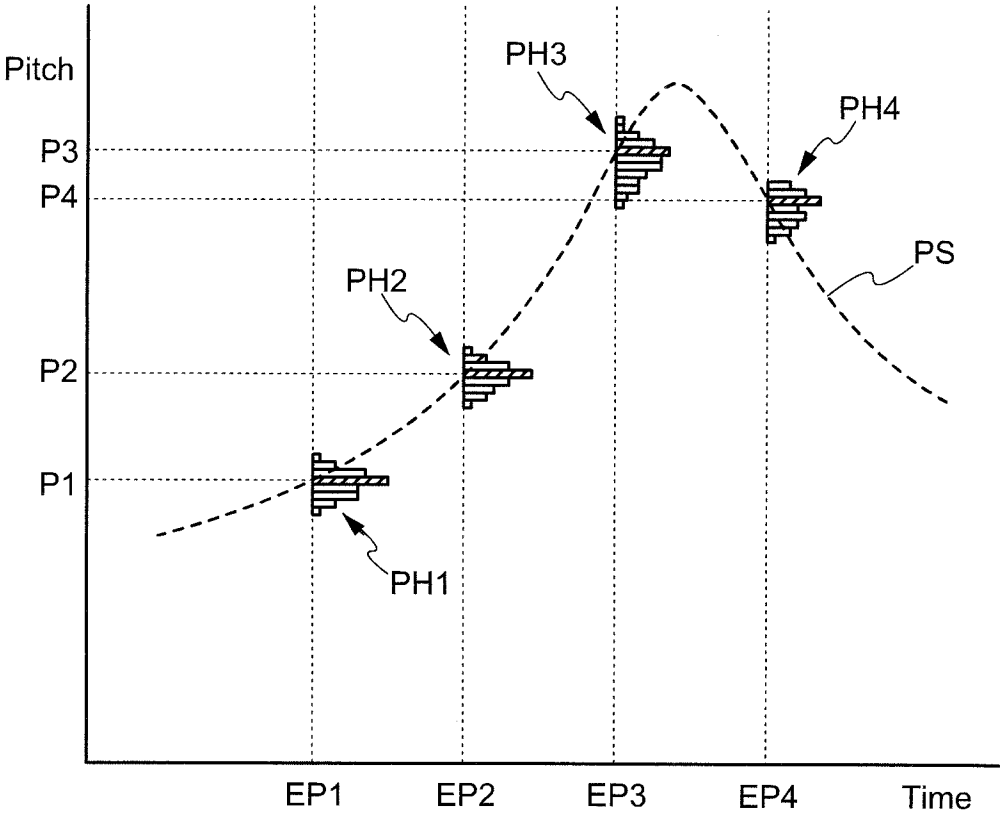
FIG. 5 is a conceptual diagram for extracting representative pitch waveform data in singing voices in the past using feature quantity data.

Although evaluation can be performed in both a singing and a performance, as described above, one example of the evaluation of the singing will be described with reference to FIG. 5 to FIG. 7C. FIG. 5 is a conceptual diagram for extracting representative pitch waveform data in singing voices in the past using feature quantity data. In FIG. 5, a horizontal axis represents time, and a vertical axis represents a pitch. On the time axis, a plurality of evaluation points EP1, EP2, EP3, and EP4 are illustrated. The evaluation point is a concept for specifying a predetermined timing at which the singing evaluation is performed, and may be a predetermined time or a predetermined period.

While the four evaluation points are illustrated as one example of the evaluation point in FIG. 5, it can be optionally determined where the evaluation point is set. The density of the evaluation point may be adjusted depending on a degree of importance or a degree of difficulty of a singing portion in an entire musical piece. For example, the number of evaluation points may be increased for a portion where the degree of importance or the degree of difficulty is high, and the number of evaluation points may be decreased for a portion where the degree of importance or the degree of difficulty is low.

On axes of the evaluation points EP1, EP2, EP3, and EP4, histograms PH1, PH2, PH3, and PH4 respectively representing distributions of pitches in the singing voices in the past are illustrated. That is, it is found that in each of the evaluation points, the pitches of the singing voices in the past are respectively distributed in predetermined widths. That is caused by a variation among singing voices by singers, indicates that the larger a peakedness of the distribution is, the more singers sing in the same way, and means that the smaller the peakedness is, the more different ways of singing by singers are. In other words, the evaluation point can be said to mean that the larger the peakedness of the distribution is, the lower the degree of difficulty is and mean that the smaller the peakedness of the distribution is, the higher the degree of difficulty is.

At this time, pitch waveform data PS obtained by connecting respective pitches P1, P2, P3, and P4 serving as modes in the histograms PH1, PH2, PH3, and PH4 is pitch waveform data using a representative value of the pitches in the singing voices in the past (hereinafter referred to as "reference pitch waveform data"). The reference pitch waveform data PS can be generated by the evaluation value calculation unit 107 illustrated in FIG. 3, for example.

Figure 6:
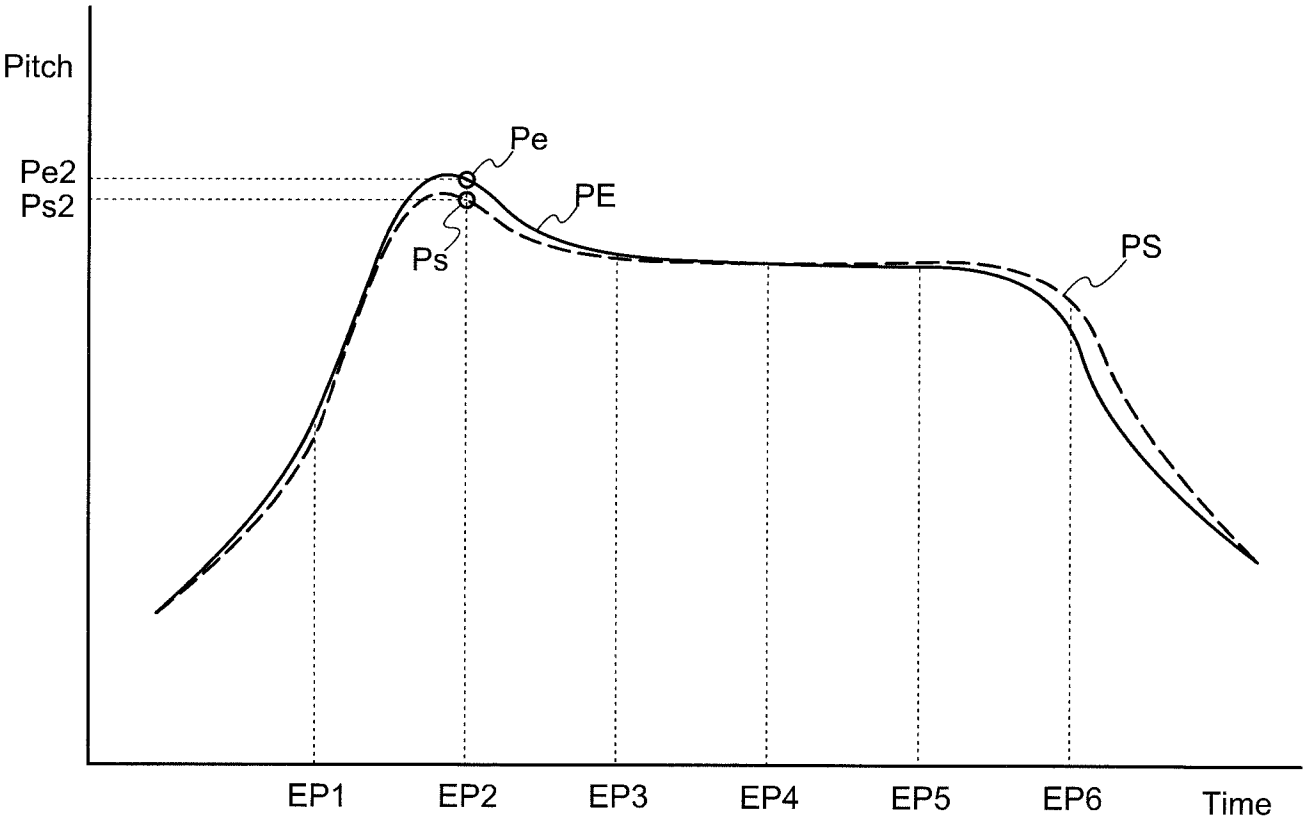
FIG. 6 is a diagram illustrating an example of a case where pitch waveform data to be evaluated and pitch waveform data serving as an evaluation criterion.

FIG. 6 is a diagram illustrating an example of a case where pitch waveform data to be evaluated and pitch waveform data serving as an evaluation criterion are compared with each other. In FIG. 6, pitch waveform data PE to be evaluated (hereinafter referred to as "evaluation pitch waveform data PE") is waveform data obtained by arranging feature quantities calculated by the feature quantity calculation unit 103 illustrated in FIG. 3 in time series. As illustrated in FIG. 6, "deviation" generally occurs between the evaluation pitch waveform data PE and the reference pitch waveform data PS. This deviation means that a pitch by a singer to be evaluated and respective pitches by most singers in the past deviate from each other.

In FIG. 6, when an evaluation point EP2 is paid attention to, a pitch at a point Pe on the evaluation pitch waveform data PE is Pe2, and a pitch at a point Ps on the reference pitch waveform data PS is Ps2. That is, in the evaluation point EP2, an amount of deviation corresponding to |Pe2−Ps2| occurs between the evaluation pitch waveform data PE and the reference pitch waveform data PS. In the present embodiment, the amount of deviation is used to calculate an evaluation value in the evaluation value calculation unit 107 illustrated in FIG. 3.

Figure 7A:
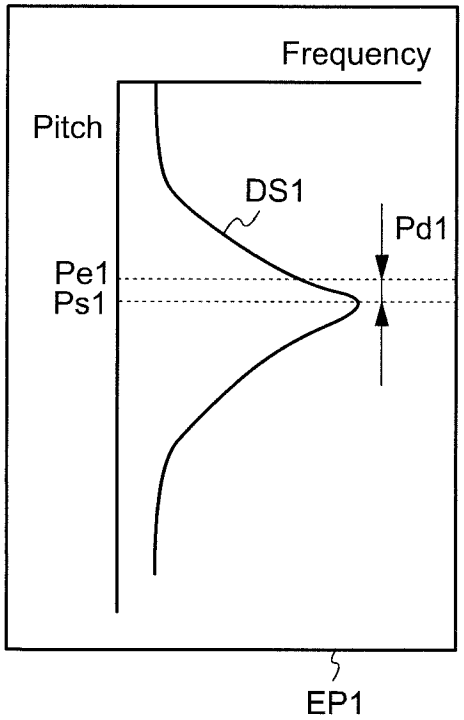
FIG. 7A is a diagram for illustrating a pitch distribution state in each evaluation point and an amount of deviation between a pitch to be evaluated and a pitch serving as an evaluation criterion.
Figure 7B:
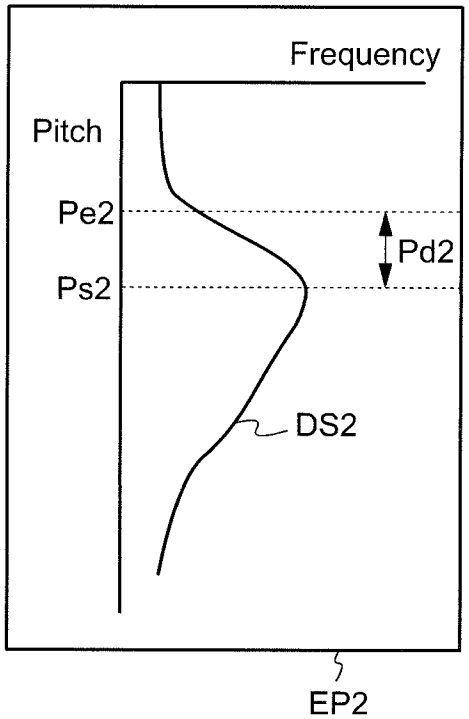
FIG. 7B is a diagram for illustrating a pitch distribution state in each evaluation point and an amount of deviation between a pitch to be evaluated and a pitch serving as an evaluation criterion.
Figure 7C:
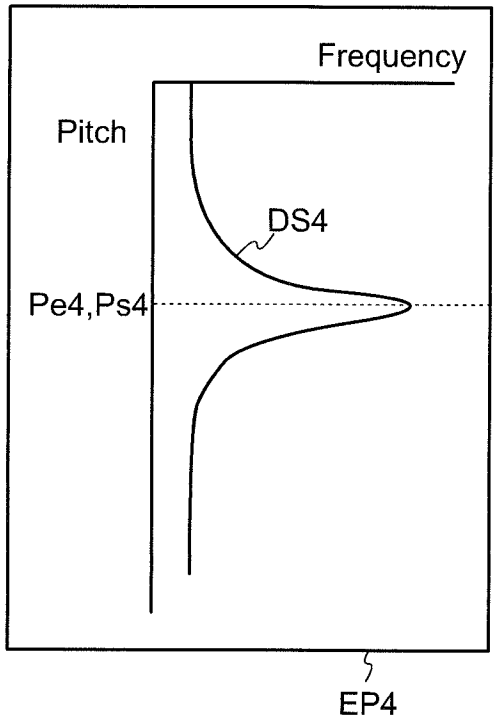
FIG. 7C is a diagram for illustrating a pitch distribution state in each evaluation point and an amount of deviation between a pitch to be evaluated and a pitch serving as an evaluation criterion.

FIGS. 7A, 7B, and 7C are diagrams for each illustrating a pitch distribution state in an evaluation point and an amount of deviation between a pitch to be evaluated and a pitch serving as an evaluation criterion. FIG. 7A illustrates a pitch distribution state in an evaluation point EP1, FIG. 7B illustrates a pitch distribution state in an evaluation point EP2, and FIG. 7C illustrates a pitch distribution state in an evaluation point EP4.

In FIG. 7A, a pitch distribution state DS1 in the evaluation point EP1 exhibits a substantially normal distribution, and indicates that it varies less among respective pitches of singing voices in the past. At this time, there exists an amount of deviation Pd1 (=|Pe1−Ps1|) between a pitch Ps1 corresponding to a peak and a pitch Pe1 in a singing voice to be evaluated in the distribution state DS1.

The evaluation value calculation unit 107 calculates an evaluation value using the amount of deviation Pd1. For example, the evaluation value may be changed, by setting a first threshold value and a second threshold value and classifying the amount of deviation Pd1 into a case where the amount of deviation Pd1 is smaller than the first threshold value, a case where the amount of deviation Pd1 is larger than the first threshold value and smaller than the second threshold value, and a case where the amount of deviation Pd1 is larger than the second threshold value, depending on to which of the cases the amount of deviation Pd1 corresponds. The amount of deviation Pd1 can also be used as it is as an evaluation value. In addition to setting the above-described threshold values to find the evaluation value, it may be found how many times the amount of deviation Pd1 is a standard deviation of the pitch distribution state DS1, and it may be evaluated within which percent of a population a deviation of a singing voice to be evaluated from a representative value falls.

In FIG. 7B, a pitch distribution state DS2 in the evaluation point EP2 exhibits a slightly board distribution, and indicates that it varies much among respective singing voices in the past. At this time, there exists an amount of deviation Pd2 (=|Pe2−Ps2|) between a pitch Ps2 corresponding to a peak in the distribution state DS2 and a pitch Pe2 in the singing voice to be evaluated. The evaluation value calculation unit 107 calculates an evaluation value using the amount of deviation Pd2.

In FIG. 7C, a pitch distribution state DS4 in the evaluation point EP4 exhibits a distribution having a large peakedness (a distribution having a sharp peak), and indicates that it varies less among respective singing voices in the past. At this time, a pitch Ps4 corresponding to a peak in the distribution state DS4 and a pitch Pe4 in a singing voice to be evaluated do not deviate from and completely match each other. In this case, in calculating the evaluation value in an evaluation value calculation unit 107, an amount of deviation may be treated as being zero. If singing evaluation is performed using a point deduction system, for example, the evaluation value is not deducted as being zero. If singing evaluation is performed using a point addition system, a specific addition point may be added.

As described above, the evaluation value calculation unit 107 can analyze a relationship between a pitch in a singing voice to be evaluated and a distribution of respective pitches in a plurality of singing voices in the past for each evaluation point and determine an evaluation value depending on to what extent the pitch to be evaluated deviates from the distribution of the pitches in the plurality of singing voices in the past. In the evaluation unit 109 illustrated in FIG. 3, evaluation is performed using the evaluation value calculated by the evaluation value calculation unit 107.

It can also be said that the pitch distribution states respectively illustrated in FIGS. 7A, 7B, and 7C each represent a degree of importance or a degree of difficulty of a singing in the evaluation point. For example, in the evaluation point EP2, the distribution state DS2 is broad. Therefore, it is found that a pitch variously changes depending on a singer. That is, it can be presumed that the pitch varies because the degree of difficulty is high or the pitch varies because the degree of importance is low (i.e., a state where most singers are appropriately singing) in the vicinity of the evaluation point EP2. Thus, the evaluation unit 109 can perform such evaluation that weighting of the evaluation value in the evaluation point EP2 is reduced (also including a case where the evaluation value in the evaluation point EP2 is not considered).

On the other hand, in the evaluation point EP4, the distribution state DS4 exhibits a steep peak. Therefore, it is found that there is almost no difference between respective pitches by a plurality of singers. That is, it can be presumed that the degree of difficulty is low or the degree of importance is high (i.e., is in a state where most singers are deliberately singing) in the vicinity of the evaluation point EP4. Thus, the evaluation unit 109 can perform such evaluation that weighting of the evaluation value in the evaluation point EP4 is increased.

As described above, the evaluation unit 109 can weigh the evaluation value calculated by the evaluation value calculation unit 107 depending on a degree of scatter (e.g., standard deviation or dispersion) of a distribution of feature quantities when a singing voice is evaluated. Thus, weighting is changed for each evaluation point so that appropriate evaluation following a tendency of a plurality of singing voices in the past can be performed.

Second Embodiment

A musical sound evaluating function 100*a* in a second embodiment of the present invention differs from the musical sound evaluating function 100 in the first embodiment in that key shift processing is performed for a feature quantity calculated by a feature quantity calculation unit 103. In the present embodiment, description is made by paying attention to a constitutional difference from the musical sound evaluating function 100 in the first embodiment. The same units are respectively assigned the same reference numerals, and hence description thereof is not repeated.

Figure 8:
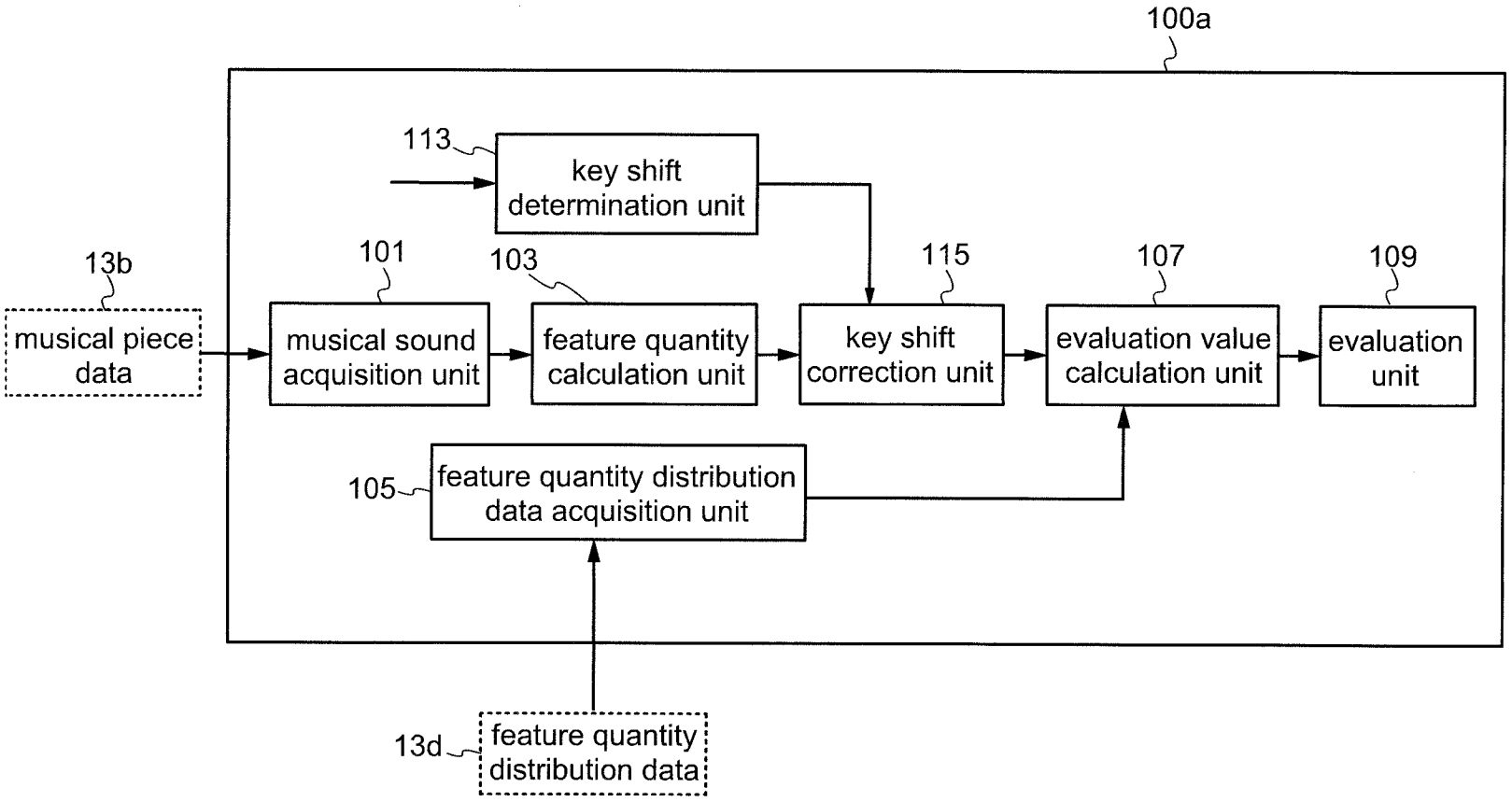
FIG. 8 is a block diagram illustrating a configuration of a musical sound evaluating function in a second embodiment.

FIG. 8 is a block diagram illustrating a configuration of the musical sound evaluating function 100*a* in the second embodiment of the present invention. The musical sound evaluating function 100*a* is implemented by a control unit 11 in an evaluation device 10 executing a control program 13*a* stored in a storage unit 13. The musical sound evaluating function 100*a* includes a musical sound acquisition unit 101, a feature quantity calculation unit 103, a feature quantity distribution data acquisition unit 105, a key shift determination unit 113, a key shift correction unit 115, an evaluation value calculation unit 107, and an evaluation unit 109.

The key shift determination unit 113 analyzes a pitch inputted from the feature quantity calculation unit 103 and determines a key shift amount of a singing voice. In the present embodiment, the key shift amount is determined by acquiring a key shift input value (a shift amount of a key set by a singer or a shift amount of a key previously set in a musical piece) from musical piece data 13*b* stored in the storage unit 13. The key shift determination unit 113 determines that there is no key shift for a singing voice when there is no key shift input value. The determination unit 113 determines that there is a key shift for a singing voice when there is a key shift input value, and outputs the input value to the key shift correction unit 115 as a key shift amount.

The key shift correction unit 115 performs correction to cancel the key shift depending on the key shift amount inputted from the key shift determination unit 113 for the pitch calculated by the feature quantity calculation unit 103. Thus, even when a singer has sung in any key, singing evaluation can be performed without being affected thereby.

While an example in which the key shift amount is determined based on the key shift input value acquired from the musical piece data 13*b* has been illustrated in the present embodiment, the key shift amount can also be determined based on the pitch calculated by the feature quantity calculation unit 103. For example, the key shift amount may be determined based on a difference between a pitch in a flat portion of evaluation pitch waveform data and a pitch in a flat portion of reference pitch waveform data acquired from feature quantity distribution data. Alternatively, for example, the key shift amount may be determined based on a difference between an average pitch in entire evaluation pitch waveform data and an average pitch in entire reference pitch waveform data acquired from feature quantity distribution data.

Third Embodiment

A musical sound evaluating function 100*b* in a third embodiment of the present invention differs from the musical sound evaluating function 100 in the first embodiment in that evaluation considering section information of an entire musical piece is performed when singing evaluation is performed by an evaluation unit 109*a*. In the present embodiment, description is performed by paying attention to a constitutional difference from the musical sound evaluating function 100 in the first embodiment. The same units are respectively assigned the same reference numerals, and hence description thereof is not repeated.

Figure 9:
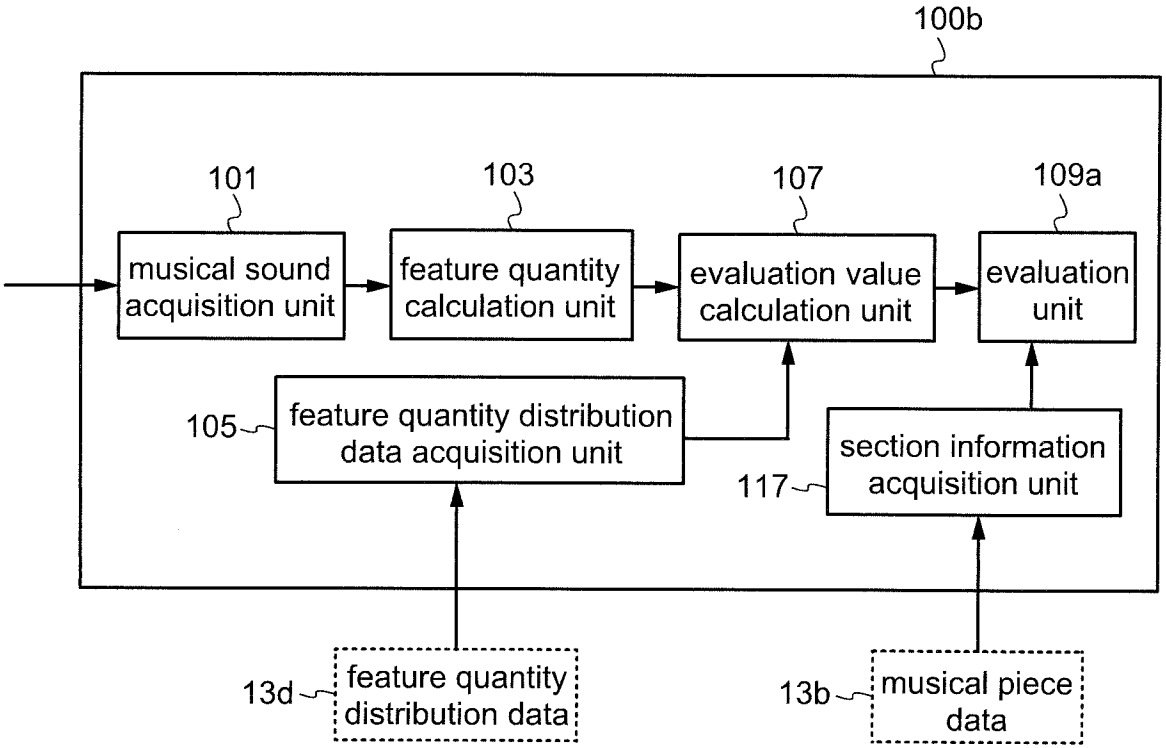
FIG. 9 is a block diagram illustrating a configuration of a musical sound evaluating function in a third embodiment.

FIG. 9 is a block diagram illustrating a configuration of the musical sound evaluating function 100*b* in the third embodiment of the present invention. The musical sound evaluating function 100*b* is implemented by a control unit 11 in an evaluation device 10 executing a control program 13*a* stored in a storage unit 13. The musical sound evaluating function 100*b* includes a musical sound acquisition unit 101, a feature quantity calculation unit 103, a feature quantity distribution data acquisition unit 105, an evaluation value calculation unit 107, a section information acquisition unit 117, and an evaluation unit 109*a*.

The section information is information accompanying for each section in a musical piece (also referred to as an accompanying piece), and is information representing a feature of a section in a musical piece, such as a musical structure like a distinction among "verse", "bridge", and "chorus". The section information acquisition unit 117 can acquire section information from the musical piece data 13*b* stored in the storage unit 13, for example. However, the present invention is not limited to this. Section information may be acquired from a data processing device 20 via a network 40.

The evaluation unit 109*a* evaluates a singing voice in consideration of the section information acquired by the section information acquisition unit 117. For example, the evaluation unit 109*a* can weight an evaluation value depending on the section information and change a degree of importance of the evaluation for each section. More specifically, the evaluation unit 109*a* can decrease the degree of importance by decreasing the weighing of the evaluation value when the section information is "verse" or "bridge" and can increase the degree of importance by increasing the weighting of the evaluation value when it is "chorus".

If the section information has information representing a degree of difficulty, the strength or weakness of weighting can be adjusted depending on the degree of difficulty. For example, if the degree of difficulty of a low pitch portion (base portion) in an entire musical piece is set high, weighting of evaluation of the portion may be set low. If a degree of difficulty of a high pitch portion (treble portion) is set high, weighting of evaluation of the portion may be set high.

According to a configuration of the present embodiment, an evaluation value can be weighted in a simple method without using a degree of scatter in a pitch distribution state for each evaluation point so that more flexible singing evaluation can be performed at high speed.

(Modification 1)

While an example in which a pitch (basic frequency) is used as a feature quantity of a singing voice has been illustrated in each of the above-described embodiments 1 to 3, feature quantities which can be calculated from singing voice data, such as a sound volume, a strength (power value) of a specific frequency band, and a harmonic sound ratio, can also be used as the feature quantity. The feature quantities differ in value to be acquired depending on a difference in gain, and thus are desirably previously corrected, if the gain is known, using the value. If the gain is unclear, the feature quantity such as the sound volume may be corrected, by calculating an average value of an entire singing voice, such that the average value matches a predetermined value. For the harmonic sound ratio, a technique described in Japanese Patent Application Laid-Open No. 2012-194389 may be referred to.

As another method, a difference between respective feature quantities such as sound volumes in adjacent evaluation points is found. A frequency distribution may be calculated using the difference. By this method, a tendency of a relative distribution of the feature quantities such as the sound volumes can be calculated. Therefore, the distribution of the feature quantities can be grasped without depending on a gain. If the difference between the feature quantities such as the sound volumes in the adjacent evaluation points is found, respective rise points of the feature quantities can also be determined using the difference. When rise timings of the feature quantities such as the sound volumes are respectively collected from a plurality of singing voices in the past, a distribution of timings of rises of the feature quantities, i.e., singings can also be found and used for singing evaluation.

(Modification 2)

While an example in which an amount of deviation between a pitch to be evaluated and a pitch serving as an evaluation criterion is used in calculating an evaluation value in an evaluation value calculation unit 107 has been described in each of the above-described embodiments 1 to 3, a ratio of a frequency of the pitch to be evaluated to a frequency of the pitch serving as an evaluation criterion can also be used.

Figure 10:
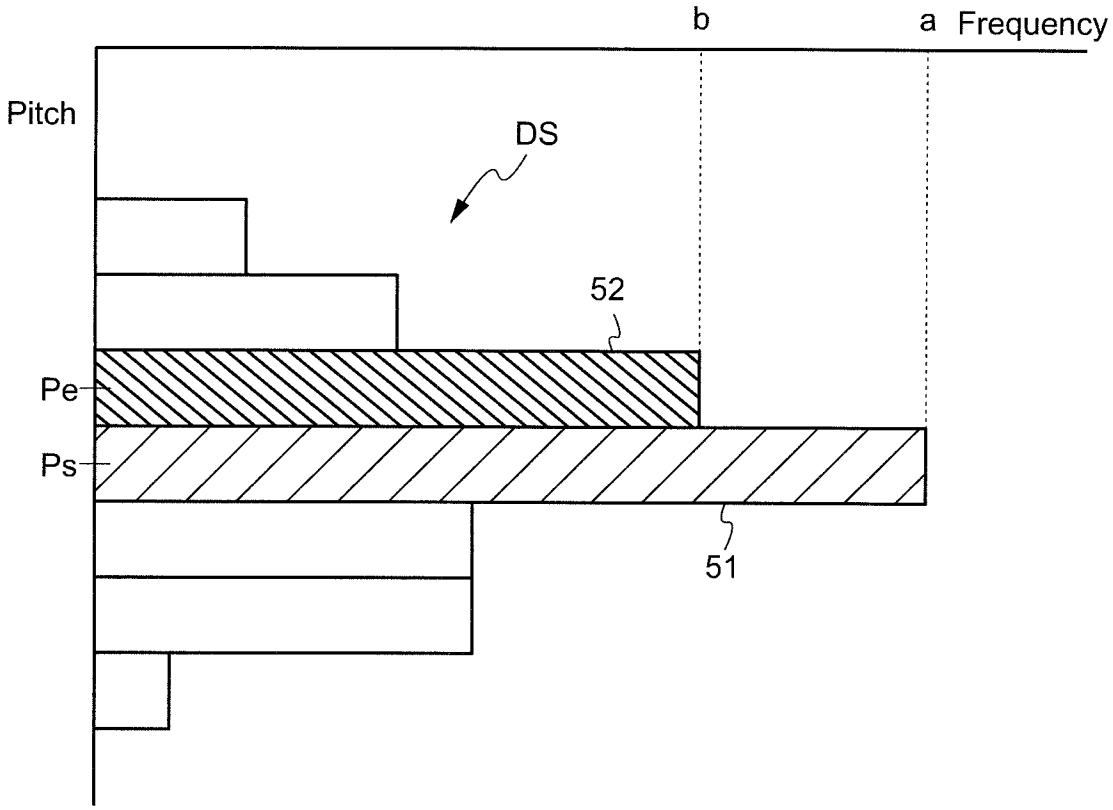
FIG. 10 is a diagram illustrating a histogram of pitches in a predetermined evaluation point in feature quantity distribution data.

FIG. 10 is a diagram illustrating a histogram of pitches in a predetermined evaluation point in feature quantity distribution data. In a histogram DS illustrated in FIG. 10, a pitch Ps corresponding to a class 51 representing a frequency a corresponding to a mode is a pitch serving as an evaluation criterion, and a pitch Pe corresponding to a class 52 representing a frequency b is a pitch to be evaluated. A median of a pitch range in the class 51 is the pitch Ps, and a median of a pitch range in the class 52 is the pitch Pe.

At this time, the evaluation value calculation unit 107 can calculate an evaluation value by calculating a calculation expression b/a, for example. However, the present invention is not limited to this. If a ratio of the frequency of the pitch to be evaluated to the frequency of the pitch serving as the evaluation criterion can be found, any calculation expression may be used.

While a pitch has been illustrated as an example of a feature quantity, the same applies to feature quantities, which can be calculated from singing voice data, such as a sound volume, a strength (power value) of a specific frequency band, and a harmonic sound ratio. For the feature quantities such as the sound volume, it is preferable to find a difference between respective feature quantities in adjacent evaluation points and calculate a frequency distribution using the difference to cancel an effect of a gain, as described in the modification 1.

(Modification 3)

While a case where a singing technique (vibrate, falsetto, "riffs and runs (kobushi)", etc.) is incorporated into a singing voice has not been considered in each of the above-described embodiments 1 to 3, means for separately detecting a singing technique may be separately provided to perform singing evaluation in consideration of the singing technique.

For example, a singing technique may be detected using a known method every respective feature quantity data in a plurality of singing voices in the past to determine whether evaluation of the singing technique is higher or lower in response to the proportion of the singing voice into which the singing technique is incorporated. More specifically, feature quantity distribution data, including the singing technique, may be generated if the proportion of the singing voice, into which the singing technique is incorporated, is high, and feature quantity distribution data may be generated without considering a feature quantity in a portion into which the singing technique is incorporated if the proportion is low.

This method enables a problem that if the singing technique is incorporated into the singing voice, evaluation is lowered due to most other singers not incorporating a singing technique into their respective singing voices to be improved.

(Modification 4)

While an example in which a singing voice of a person is evaluated has been described in each of the above-described embodiments 1 to 3, a sound emitted from a musical instrument or a synthetic singing sound (a singing sound generated by synthesizing waveforms to obtain a designated pitch while combining voice segments corresponding to characters constituting a lyric) can also be evaluated.

(Modification 5)

While an example in which a karaoke device has been described as an example of an evaluation device in each of the above-described embodiments 1 to 3, the present invention can also be applied to other devices. For example, the present invention can also be used as a practice training device in a case where a plurality of singers sing in chorus for a choral piece.

More specifically, respective singing voices of all singers are independently acquired, and statistical processing for feature quantity data respectively found for the singing voices is performed, to generate feature quantity distribution data. Moreover, singing evaluation is performed using the feature quantity distribution data and a feature quantity found from each of the singing voices. The singing evaluation enables an attempt to perform singing correction by appropriately leading the singer who greatly deviates from an average value found from the feature quantity distribution data, for example. While a case where the singer sings in chorus has been described as an example, the same applies to an ensemble by playing a plurality of musical instruments. That is, performance evaluation can also be performed, by independently acquiring respective performance sounds of all players and performing statistical processing for feature quantity data respectively found for the performance sounds, using generated feature quantity distribution data and a feature quantity found from each of the performance sounds.

While addition, deletion, or design change of a component or components or addition, deletion, or condition change of a process or processes appropriately performed by those skilled in the art based on the configurations respectively described as the embodiments of the present invention also falls within the scope of the invention without departing from the spirit of the invention.

Other functions and effects different from the functions and effects respectively produced by the above-described embodiments are construed to be naturally produced by the present invention if they are clear from the description of the specification or easily predictable by those skilled in the art.

What is claimed is:

1. A musical sound evaluation device comprising:

a musical sound acquisition unit which acquires an inputted musical sound;

a feature quantity calculation unit which calculates a feature quantity from the musical sound;

a feature quantity distribution data acquisition unit which acquires feature quantity distribution data from a database, the feature quantity distribution data representing a distribution of respective feature quantities for a plurality of musical sounds previously acquired;

an evaluation value calculation unit which calculates an evaluation value for the inputted musical sound based on the feature quantity calculated by the feature quantity calculation unit and the feature quantity distribution data acquired by the feature quantity distribution data acquisition unit; and an evaluation unit which evaluates the musical sound based on the evaluation value.

2. The musical sound evaluation device according to claim 1, wherein the evaluation unit weights the evaluation value depending on a degree of scatter of the distribution of the feature quantities.

3. The musical sound evaluation device according to claim 1, further comprising a key shift determination unit which determines an amount of key shift in the inputted musical sound, and a key shift correction unit which corrects the feature quantity calculated by the feature quantity calculation unit by canceling the amount of key shift determined by the key shift determination unit.

4. The musical sound evaluation device according to claim 1, further comprising a section information acquisition unit which acquires section information including information representing a feature for each section in the inputted musical sound, wherein the evaluation unit weights the evaluation value based on the section information.

5. An evaluation criteria generation device comprising:

a musical sound information acquisition unit which acquires information representing a musical sound;

a feature quantity data acquisition unit which acquires feature quantity data respectively representing temporal changes of feature quantities for n musical sounds; and a feature quantity distribution data generation unit which performs statistical processing using the feature quantity data for the musical sounds acquired from the information representing the musical sound and the respective feature quantity data for the n musical sounds, to generate feature quantity distribution data for output to a database, the feature quantity distribution data representing a distribution of respective feature quantities for (n+1) musical sounds.

6. The evaluation criteria generation device according to claim 5, further comprising an output unit which outputs an identifier for identifying a musical piece related to the musical sound and the feature quantity distribution data to the outside in association with each other.

7. A musical sound evaluation method comprising:

acquiring an inputted musical sound;

calculating a feature quantity from the musical sound;

acquiring feature quantity distribution data from a database, the feature quantity distribution data representing a distribution of respective feature quantities for a plurality of musical sounds previously acquired;

calculating an evaluation value for the inputted musical sound based on the calculated feature quantity and the acquired feature quantity distribution data; and evaluating the musical sound based on the evaluation value.

8. The musical sound evaluation method according to claim 7, wherein the evaluating the musical sound comprises weighting the evaluation value depending on a degree of scatter of the distribution of the feature quantities.

9. The musical sound evaluation method according to claim 7, further comprising determining an amount of key shift in the inputted musical sound, and correcting the feature quantity calculated from the musical sound using the determined amount of key shift.

10. The musical sound evaluation method according to claim 7, further comprising acquiring section information including information representing a feature for each section in the inputted musical sound, wherein the evaluating the musical sound comprises weighting the evaluation value based on the section information.

11. An evaluation criteria generation method comprising:

acquiring information representing a musical sound;

acquiring feature quantity data respectively representing temporal changes of feature quantities for n musical sounds;

performing statistical processing using the feature quantity data for the musical sounds acquired from the information representing the musical sound and the respective feature quantity data for the n musical sounds, to generate feature quantity distribution data for output to a database, the feature quantity distribution data representing a distribution of respective feature quantities for (n+1) musical sounds.

12. The evaluation criteria generation method according to claim 11, further comprising outputting an identifier for identifying a musical piece related to the musical sound and the feature quantity distribution data to the outside in association with each other.

* * * * *